US007059756B2

(12) United States Patent
Prinz et al.

(10) Patent No.: US 7,059,756 B2
(45) Date of Patent: Jun. 13, 2006

(54) DISPLAY DEVICE

(75) Inventors: Michael Prinz, Leutkirch (DE); Dirk Golz, Wangen (DE); Reinhard Lutz, Wangen (DE)

(73) Assignee: Diehl AKO Stiftung & Co. KG, Wangen (DE)

( * ) Notice: Subject to any disclaimer, the term of this patent is extended or adjusted under 35 U.S.C. 154(b) by 176 days.

(21) Appl. No.: 10/472,022

(22) PCT Filed: Mar. 14, 2002

(86) PCT No.: PCT/EP02/02896

§ 371 (c)(1),
(2), (4) Date: Mar. 10, 2004

(87) PCT Pub. No.: WO02/074041

PCT Pub. Date: Sep. 26, 2002

(65) Prior Publication Data

US 2004/0155788 A1 Aug. 12, 2004

(30) Foreign Application Priority Data

Mar. 16, 2001 (DE) ..... 101 12 640

(51) Int. Cl.
*F21V 5/00* (2006.01)

(52) U.S. Cl. ..... 362/559; 362/555

(58) Field of Classification Search ..... 362/554–556, 362/559; 340/815.42; 385/901
See application file for complete search history.

(56) References Cited

U.S. PATENT DOCUMENTS

| | | | | |
|---|---|---|---|---|
| 4,358,708 | A * | 11/1982 | Silva et al. | 315/58 |
| 5,268,823 | A * | 12/1993 | Yergenson | 362/555 |
| 5,349,504 | A * | 9/1994 | Simms et al. | 362/555 |
| 5,874,901 | A | 2/1999 | Obyama | |

FOREIGN PATENT DOCUMENTS

| | | |
|---|---|---|
| DE | 27 07 081 A1 | 2/1977 |
| DE | 34 15 229 C2 | 4/1984 |
| DE | 94 07 115.2 | 4/1994 |
| DE | 198 51 505 A1 | 11/1998 |

* cited by examiner

*Primary Examiner*—Ali Alavi
(74) *Attorney, Agent, or Firm*—Scully, Scott, Murphy & Presser

(57) ABSTRACT

Described is a display device (10) with a printed circuit board (12), with at least one light source (14) and with a single-segment or multi-segment display (16) which is connected by optical waveguides (46) to the light sources (14) which are preferably SMD-LEDs. The display device (10) has a block (18) for holding the optical waveguides (46) firmly in position, with a front surface associated with the single-segment or multi-segment display (16) and a base surface associated with the light sources (14). The optical waveguides (46) are in the form of light fingers (38, 42) which extend through the block (18). The printed circuit board (12) can include any angle of between 0 and ≧90° with the multi-segment display (16).

18 Claims, 1 Drawing Sheet

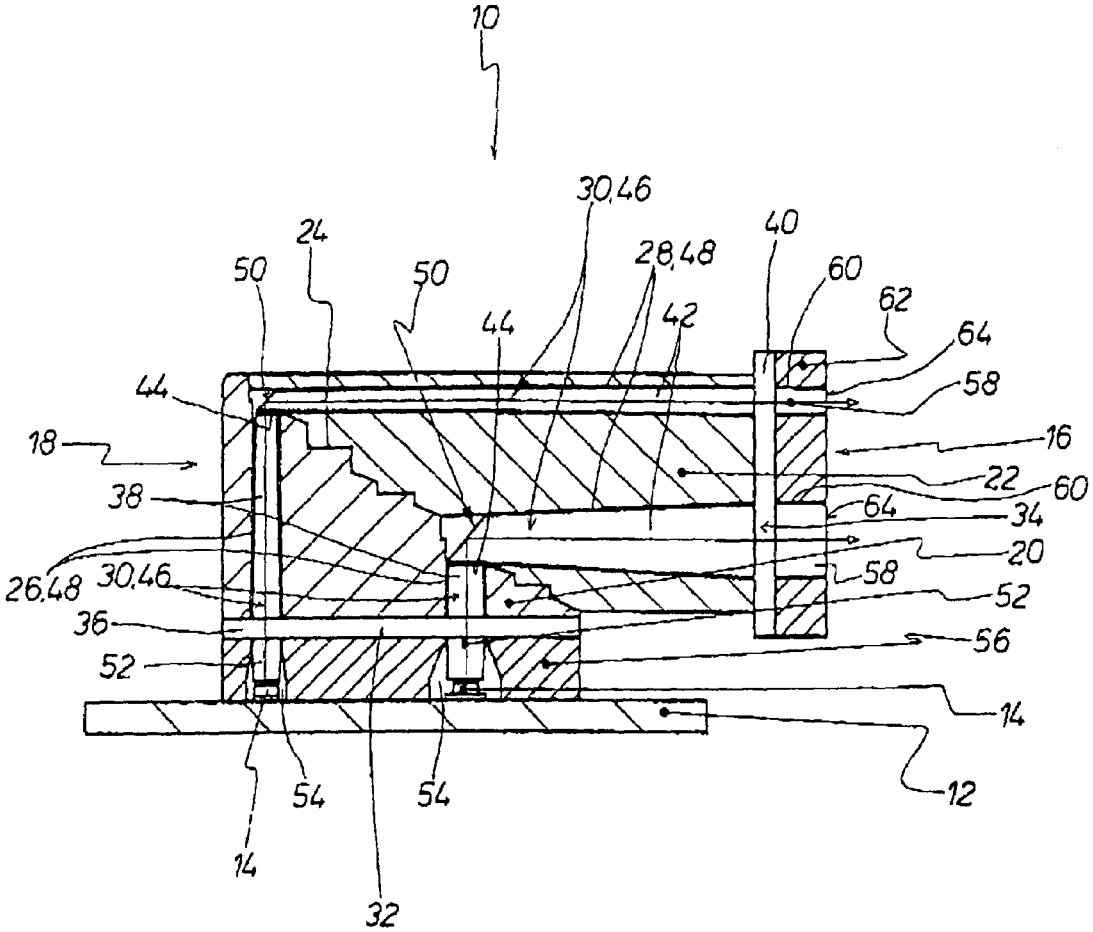
10
30,46
24
40
50
50
28,48
60
62
44
42
64
44
58
18
16
22
60
38
64
34
20
26,48
30,46
58
52
36
56
52
14
54
54
12
14
32

DISPLAY DEVICE

The invention concerns a display device including display segment, wherein optical waveguides extend non-linearly between the display segments and light sources which are associated therewith, preferably SMD-LEDs.

Display devices of that kind are used for example in domestic appliances such as fully integrated dishwashers or the like. Known display devices often have two circuit boards, namely a power circuit board and an operating or display circuit board.

DE 34 15 229 C2 discloses a light display arrangement for the optical display of a plurality of items of information on a display panel which has areas to be lit up, on to the rear side of each of which is directed the end of a respective optical fiber bundle, the other end of which can be lit by a light source whose light, which is directed on to the end of the optical fiber bundle, is interrupted or allowed to pass in dependence on the respective item of information. That known light display arrangement is characterised in that the operating condition of the respective light source can be set in dependence on the items of information, that the items of information are operating conditions of light sources which are distributed spatially in an installation whose plan is provided true to scale or diagrammatically on the display panel with the ends of the optical fiber bundles on the rear side of those areas at which there is a respective light source in the installation, that the ends of the optical fiber bundles are ground flat, they are surrounded by a cylindrical holder and they are fitted into bores which extend from the rear side of the transparent display panel and which do not pass continuously therethrough, and that, when the display panel has a flat front surface, provided between the flat ends of the optical fiber bundles and the display panel is a respective conical or substantially conical intermediate air space.

DE 36 16 446 A1 describes a time display device having an analog display, a clock mechanism and a dial with associated hands. At the display points for hours, minutes and optionally seconds, the dial has bores which each accommodate the one respective end of an optical fiber, the other end of which is taken to the corresponding point of a time display surface of any desired configuration, being remote from the primary dial. Arranged in front of the primary dial is a light source which shines light thereon. The hands have transparent color plate portions for differently coloring the light of the light source, which light is received by the ends of the optical fibers, which are fitted in the bores in the dial.

A miniature front panel installation element for printed circuit board mounting is known from DE 94 07 115 U1. That known installation element comprises two switch elements and two light displays in a plastic housing which is of dimensions of about 5×15×16 $mm^3$ and which is suitable for automatic fitting.

A motor vehicle orientation light comprising one or more light emitting diodes which are assembled in a holder with an optical waveguide connected in front thereof, to form a functional unit, in such a way that in different constructions the optical waveguides lead by way of light deflection by means of prisms or mirrors by way of the light emitting surface for casting light on the irradiation surfaces or which lead by way of the prisms or mirrors to a means for complete deflection of the entire light beam, wherein the power supply can be regulated by way of integrated series resistors which are connected to LED-terminals, is known from DE 296 13 798 U1.

DE 198 51 505 A1 discloses a switch element with a light transmitter which is arranged adjacent to a coupling-in location of an optical waveguide arrangement. That known switch element also has a light receiver which is arranged adjacent to a coupling-out location of the optical waveguide arrangement, wherein the optical waveguide arrangement has an actuating surface through which the light emanating from the light transmitter shines and the light receiver which is responsive to light from the region of the actuating surface is connected to an electronic evaluation system which causes a change in the switch condition when a predetermined threshold value is exceeded by the signal level of the output signal produced by the light receiver.

The measures which form the classifying portion of the main claim, being the state of the art, are known from DE 27 07 081 A1. That arrangement for each display element has a wedge-shaped optical waveguide, to the narrow end region of which is fitted the light source which shines thereinto, while in opposite relation thereto the wide end or laterally thereto a strip-shaped light exit surface forms the display segment. The individual, board-shaped optical waveguides which extend in a bent configuration in accordance with the respective factors involved, in respect of the position and orientation of the segment, fit with their narrow light entry ends in a positioning plate in staggered, closely mutually juxtaposed and superposed relationship. They are fixed in opposite relationship in such a way that the desired display geometry is afforded by the individual segments. However, that appropriate assembly of optical waveguides which are of different complex shapes is very expensive from the point of view of production engineering, quite apart from precision problems in respect of the segmented display, for example when the display device is subjected to a mechanical loading.

U.S. Pat. No. 5,874,901 A provides a stepped structure of optical waveguide bars which extend in a right-angled bent configuration in order to pass the light emitted from light sources arranged on a printed circuit board to exit openings in a cover plate. In that way however the optical waveguides are interrupted and thereby separated into a feed portion and a display portion in order to make the display portion mobile relative to the feed portion and to close the respective light path only in a given relative position. The finger-shaped optical waveguide bars which project in cantilever relationship towards each other, except for a few spoke-shaped connections, do not however lead to an expectation of a high level of reliability in terms of simultaneity in respect of bridging all interruptions in the individual optical waveguide paths, and they are therefore suitable for use for general signalling purposes rather than for actual display purposes.

If the power circuit board and the display circuit board of a display device of the kind set forth in the opening part of this specification are provided in a common plane or in mutually parallel planes, they can be easily fitted with standard components. If the assembly does not involve a condition of parallelism, that is to say if the display plane includes a given angle which is different from 0° with the circuit board plane, then that requires additional expenditure in the form of a second printed circuit board or a connecting element which connects the two printed circuit boards together and which is usually a connecting cable. That results in additional process steps in the production operation. They have a corresponding effect on manufacturing costs.

An angled design configuration can also be embodied by relatively expensive special components which for example involve a special angle socket or customer-specific display modules.

In consideration of those factors the object of the present invention is to provide a display device of the kind set forth in the opening part of this specification, which is comparatively simple and inexpensive to produce, wherein moreover light deflection through any angle is possible, that is to say in which the printed circuit board of the at least one light source and the single-segment or multi-segment display can include any angle, with each other.

In accordance with the invention, in a display device of the kind set forth in the opening part of this specification, that object is attained by the provision of two respective light fingers which, in mutually adjoining angular relationship at coupling surfaces, form the respective optical waveguide and extend through guide passages in guide bodies which are connected together to form a block along mutually matching contact surfaces. Preferred configurations and developments of the display device according to the invention are characterised in the appendant claims.

The display device according to the invention has the advantages that it can be easily and inexpensively produced from a few individual parts, wherein the printed circuit board which is fitted with the at least one light source or with the light sources and the single-segment or multi-segment can include with each other any desired angle of between 0 and 90° and greater than 90°, depending on the respective factors involved.

Further details, features and advantages will be apparent from the description hereinafter of an embodiment of the display device according to the invention, which is shown in longitudinal section in the drawing.

The FIGURE shows an embodiment of the display device 10 with a printed circuit board 12 fitted with light sources 14. The light sources 14 are preferably SMD-LEDs. The printed circuit board is fitted with a number of light sources 14, which corresponds to the number of segments of a multi-segment display 16, only two light sources 14 being shown in the drawing. It is also possible to provide a single light source 14 or a single-segment display 16. Hereinafter however reference is made to a multi-segment display 16. The multi-segment display 16 includes a right angle with the printed circuit board 12. The display device 10 has a block 18. The block 18 comprises a first body 20 associated with the printed circuit board 10 and a second body 22, which bodies bear against each other with mutually matching contact surfaces 24 and are or become fixedly connected together. The bodies 20 and 22 serve in particular to fix optical waveguide bodies 32 and 34 definedly in space and to ensure close mutually meeting relationship of light transfer surfaces, that is to say light transfer surfaces 44 of respectively associated light fingers 38 and 42 of the optical waveguide bodies 32 and 34. The two blocks 18 and 22 can also be replaced for example by frames or by other guide elements of a suitable configuration.

In the embodiment illustrated in the drawing, the first body 20 is provided with first passages 26 and the second body 22 is provided with second passages 28. The first passages 26 are provided in the first body 20 in a manner corresponding to the light sources 14. The second passages 28 are provided in such a way that, in the assembled condition of the bodies 20 and 22 to form the block 18, they are connected together with the first passages 26 and form optical waveguide guide passages 30. The arrangement can also be injection molded around the optical waveguides. For example, the first optical waveguide body 32 with the first body 20 can be injection molded using the 2K-technology in order to produce the first optical waveguide body with the associated first body 20. The same applies in respect of the second optical waveguide body 34 with the second body 22, in which respect those two components can also be produced using the 2K-technology.

As already mentioned above, a first optical waveguide body 32 is associated with the first body 20 and a second optical waveguide body 34 is associated with the second body 22. The first optical waveguide body 32 has a first plate element 36 from which first light fingers 38 integrally project away, that is to say into the first passages 26 of the first screening body 20. The first light fingers 38 extend as far as a coupling surface 44 of the second light fingers 42. The second optical waveguide body 34 has a second plate element 40 and second light fingers 42 which integrally project away from the second plate element 40. The second light fingers 42 extend through the second passages 28 of the second body 22 of the block 18 as far as the common coupling surface 24. In the assembled condition of the first and second screening bodies 20 and 22, the first and second light fingers 38 and 42 are light-conductingly connected together by the coupling surfaces 44 which bear snugly against each other, so that the first and second light fingers 38 and 42 form corresponding optical waveguides 46. The optical waveguides 46 which are angled through 90° therefore extend through guide passages 48 which are formed by the first and second passages 26 and 28 in the first and second bodies 20 and 22.

The surface of the first and second light fingers 38 and 40 is preferably polished, whereby a high degree of reflection within the light fingers 38, 42 is achieved or the issue of stray light from the light fingers 38, 42 is prevented. The light fingers 38, 42 and the associated passages 26, 28 can be adapted to each other in terms of cross-section with a defined play tolerance so that the air in the gap between the light fingers 38, 42 and the surface of the passages 26, 28 causes total reflection of the light passed through the optical waveguide bodies 32, 34, as a consequence of optical isolation.

In the embodiment illustrated in the FIGURE the second light fingers 42 are provided in the proximity of the coupling surfaces 44 with a respective totally reflecting light deflection surface 50.

The first plate element 36 of the first optical waveguide body 32 is in the form of an intermediate plate from which the first light fingers 38 integrally project away from the one side and light source coupling portions 52 integrally project away from the second side which is in opposite relationship to the light fingers 38. The light source coupling portions 52 are associated with the light sources 14, they extend into through-holes 54 which are provided in a coupling plate 56. The coupling plate 56 preferably comprises a dark or a black, that is to say opaque material. The coupling plate 56 can be an integral component part of the printed circuit board 12 or an integral component part of an electronic module housing (not shown) which is provided for positioning of the circuit board 12.

If so-called spurious lighting or overswamping of light from the light sources 14 can be accepted within certain limits, then the coupling plate 56 can possibly also be omitted. In the event of adopting such a configuration of the last-mentioned kind, the light source coupling portions 52 are then also not present, so that the first optical waveguide body 32 only has the first plate element 36 which bears against the light sources 14, and the first light fingers 38 which are integrally connected to that element.

The second optical waveguide body 34 can be designed like the first optical waveguide body 32, that is to say the second plate element 40 of the second optical waveguide body 34 can form an intermediate plate, from the one side of which the second light fingers 42 integrally project away and from the opposite second side of which light coupling-out portions 58 integrally project away. The light coupling-out portions 58 extend virtually without play through through-holes 60 which are provided in a contour plate member 62. Like the coupling plate 46, the contour plate member 62 preferably comprises a dark or black, that is to say opaque material, thereby providing for optimisation of the contour sharpness of the multi-segment display 16 at the light exit surface 64. The light exit surface is preferably provided with a defined degree of surface roughness to ensure that the respective information symbol of the multi-segment display 16 appears as uniformly as possible.

If necessary the second optical waveguide body 34 can also be without the light coupling-out portions 58. When such a configuration of the last-mentioned kind is adopted, the second plate element 40 then forms the light exit surface which can be provided for example with a scattering foil. That scattering foil can be a scattering foil backed with printing, with or without symbols printed on the foil. If particular demands are not made on the contour sharpness of the multi-segment display 16, it is then also possible optionally to omit the above-mentioned scattering foil.

The invention claimed is:

1. A display device (10) with display segments (16), wherein optical waveguides (46) extend non-linearly between the display segments and light sources (14) associated therewith, in the form of SMD-LEDs, comprising:

two respective light fingers (38, 42) which at mutually contiguous angular contact coupling surfaces (44) form the respective optical waveguide (46), which extend through guide passages (26, 28) in guide bodies (20, 22), and which are connected together to form a block (18) along mutually matching contact surfaces (24).

2. A display device as set forth in claim 1, wherein the block (18) selectively comprises a light or white material.

3. A display device as set forth in claim 1, wherein the surface of each of the light fingers (38, 42) is polished.

4. A display device as set forth in claim 1, wherein each said light finger (42) associated with either a single-segment or multi-segment display (16) has a light exit surface (64) with a defined degree of surface roughness.

5. A display device as set forth in claim 1, wherein the first and second guide bodies (20 and 22) are respectively provided with passages (26, 28) which in the assembled condition form optical waveguide guide passages (30).

6. A display device as set forth in claim 5, wherein the light fingers (38, 42) and the guide passages (48) are adapted to each other in cross-section with a gap tolerance.

7. A display device as set forth in claim 1, wherein a first optical waveguide body (32) is associated with the first body (20) and a second optical waveguide body (34) is associated with the second body (22), wherein the first optical waveguide body (32) has a first plate element (36) from which the first light fingers (38) integrally extend away, and wherein the second optical waveguide body (34) has a second plate element (40) from which the second light fingers (42) integrally project away, wherein in the assembled condition of the first and second bodies (20 and 22) the first and second light fingers (38 and 42) are light-conductingly connected together by coupling surfaces (44) which bear snugly against each other.

8. A display device as set forth in claim 7, wherein the first or the second light fingers (38, 42) are each provided with a respective totally reflecting light deflection surface (50) in the proximity of their coupling surfaces (44).

9. A display device as set forth in claim 7, wherein the first plate element (36) is in the form of an intermediate plate, from the one side of which the first light fingers (38) extend integrally away and from the opposite second side of which light source coupling portions (52) integrally project away respectively in axially aligned relationship with the first light fingers (38).

10. A display device as set forth in claim 9, wherein there is provided a coupling plate (56) for holding the light sources (14) and the light source coupling portions (52) in place.

11. A display device as set forth in claim 10, wherein the coupling plate (56) selectively comprises a dark, a black, or an opaque material.

12. A display device as set forth in claim 10, wherein the coupling plate (56) is integrated into an electronic module housing provided for positioning of the circuit board (12).

13. A display device as set forth in claim 7, wherein the second light fingers (42) of the second plate element (40) extend into the second passages (28) of the second body (22).

14. A display device as set forth in claim 13, wherein the second plate element (40) is provided with a scattering foil at its front surface which is remote from the second light fingers (42).

15. A display device as set forth in claim 14, wherein the scattering foil is provided with symbols corresponding to the single-segment or multi-segment display (16).

16. A display device as set forth in claim 13, wherein the second plate element (40) is in the form of an intermediate plate, from which the second light fingers (42) integrally project away on the one side and from which light coupling-out portions (58) integrally project away from the opposite second side, the light coupling-out portions (58) being axially aligned with the second light fingers (42).

17. A display device as set forth in claim 16, wherein the light coupling-out portions (58) extend through a contour plate member (62).

18. A display device as set forth in claim 17, wherein the contour plate member (62) selectively comprises a dark or a black material.

* * * * *